United States Patent [19]

Ledinek

[11] Patent Number: 4,964,446

[45] Date of Patent: Oct. 23, 1990

[54] MACHINE FOR SURFACE AND THICKNESS WORKING OF SHORT AND THIN WORKPIECES

[76] Inventor: Pavel Ledinek, Pivolska 31, YU-62000 Maribor, Yugoslavia

[21] Appl. No.: 408,630

[22] Filed: Sep. 18, 1989

[30] Foreign Application Priority Data

Feb. 17, 1989 [YU] Yugoslavia ..... 374/89

[51] Int. Cl.[5] ..... B27L 11/00; B27C 1/00

[52] U.S. Cl. ..... 144/114 R; 144/118; 144/373; 409/139

[58] Field of Search ..... 144/114 R, 115, 118, 144/253 R, 369, 373; 409/139, 140, 228

[56] References Cited

U.S. PATENT DOCUMENTS 2,722,956 11/1955 Ludwig ..... 144/118

4,690,186 9/1987 Chapman ..... 144/118

*Primary Examiner*—W. Donald Bray

*Attorney, Agent, or Firm*—Dvorak and Traub

[57] ABSTRACT

The invention relates to a machine for surface and thickness working of wood workpieces of any dimensions, in particular short and thin workpieces without rigid clamping of the workpiece, consisting of a machine housing, a movable working table, a two-part baseplate with circular cutout into which a face of a milling head provided with fixed and exchangeable cutting edges is inserted. In the head, there is a guide insert. An upper guide strip is disposed in exactly the same plane as the cutting edge apex on the milling head and also in the same plane as a stationary portion of the baseplate. At least two working spindles, set at predetermined angles, are provided. The workpiece slides on the two-part baseplate guided by two flank guide rails and an upper guide strip forming together a movement channel for the workpiece.

20 Claims, 4 Drawing Sheets

MACHINE FOR SURFACE AND THICKNESS WORKING OF SHORT AND THIN WORKPIECES

The invention is concerned with a machine for surface and thickness finishing of wood workpieces of any dimensions, in particular thin workpieces of small dimension without requiring rigid clamping of the workpiece.

THE TECHNICAL PROBLEM TO BE SOLVED ACCORDING TO THE INVENTION

Known machines for surface and thickness working of wood workpieces do not for example permit the following operations:

working of wood workpieces of small dimensions without rigid clamping;

ensure high quality of the surfaces to be worked which does not require any additional finishing apart from painting, staining or lateral or surface adhering of the wood workpiece;

working of long and thin (narrow) workpieces;

working of workpieces irrespective of the movement direction and position of the workpiece;

elimination of the danger of a kickback of the workpiece or a workpiece dropping out of the working machine;

noise reduction below 82 decibel;

rapid and simple changing and setting of the workpiece;

parallelism of the surfaces of the wood workpiece to be worked;

avoiding penetration of the tool into the wood workpiece at the end and start of each working surface;

high-quality working of wood workpieces in the case of live knots, knars, etc.;

high-quality working with curved constructions or wood workpieces with special tensile and compressive properties or characteristics;

material removal up to and below 0.1 mm. DE-OS 2,158,912.8 describes a wood working machine in which the tool holder comprises two tools mounted on the same vertical shaft, an inner tool holder being inserted into the outer tool holder, this representing a tool-in-tool design. The inner tool holder with circular saw is constructed so that during working a circular motion is produced in which the outer and the inner tool holders are rotated in the same direction; an adjusting facility with regard to different peripheral speeds of one or more tool holders is possible and the inner tool holder is constructed in such a manner that it is secured to the working spindle by a threaded nut; for this purpose a corresponding depression is formed in the inner tool holder. The outer tool holder with inserted tool in the form of cutoff blades is constructionally made in the form of a truncated cone and serves for coarse preliminary working of a wood workpiece of relatively great length.

The known apparatus with double tool holder operates in such a manner that the wood workpiece of relatively great length engages into the region of the tool (inserted in pairs in the upper and lower holders); the two holders are turned at the same vertical axis through an angle of 180° with respect to each other. The outer holders with inserted tool ensure a coarse preworking; the inner tool holders with tool are for finishing wood workpieces of relatively great length.

The known apparatus with two working heads which are set at the same vertical axis and at an angle with respect to each other (turned) of 180° and has a double tool holder is disadvantageous in so far as when working the wood workpiece of very small length the latter drops into the edge region between the surface of the inner holder and the surface of the tool clamped in said holder. It can also become wedges in the depression edge for the screw connection with the shaft in the circular saw holder; also, on tool transfer friction occurs between the rotating tool and the only movable tool and when the workpiece is shorter than the tool diameter this can result in a movement of the workpiece in the tangential direction of the tool and lead to the workpiece dropping out and inaccurate working in the case of long workpieces because the tool surface, due to the rotation, cannot be used as guide support.

Such an apparatus is therefore not practicable for working workpieces of small dimensions and thin workpieces because the working qualities required are too large and high.

Furthermore, DE-OS 3,603,313 discloses a cylindrical planing spindle with inserted longitudinal cutting edges for surface working of wood workpieces which has however not proved itself in practice for surface working wood workpieces of small dimensions and thin workpieces because the opening between the fixed and moving sliding plate of the working table on the machine is governed by the diameter of the planin spindle and the thickness of the material decrease, the longitudinal opening being coaxial with the longitudinal axis of the planing spindle.

For the reasons given, in practice it is not possible with such a construction to use the plaing spindle for industrial working of working pieces of small dimensions and of thin workpieces.

The problem of providing a machine for wood surface working of workpieces of very small length, for example 2 cm, is solved by the features according to the invention.

The following is achieved compared with the known solution:

wood workpieces of very small dimensions and thin workpieces can be worked without rigid clamping of the workpiece;

it is possile to achieve a quality of the working surfaces which does not require additional finishing before painting or staining of the working surfaces or before adhering surfaces and flanks;

the wood working machine according to the invention is suitable for working wood workpieces of any dimension, in particular very small diameter and thin wood workpieces, to the required thickness, width and length;

planar surfaces of wood workpieces and surfaces at a predetermined angle can be worked;

working is possible irrespective of the direction of the workpiece movement and its position;

a minimum material removal, down to 0.1 mm, is achieved and this permits an additional veneer working;

special clamping means of varied designs are dispensed with;

a kickback danger of the workpiece or a danger of the workpiece dropping out of the machine is completely eliminated;

noise decrease to below 80 decibel;

absolute parallelism of the working surfaces on the workpiece is achieved;

completely straight working surfaces without penetration of the workpiece into the workpiece at the end and beginning of the working are ensured;

it becomes qualitatively possible to work wood workpiece surfaces with live knots or knars;

it is possible to work qualitatively wood workpieces of curved construction or with torsional and compression properties;

the machine according to the invention is simple in construction and assembly;

the tool can be easily exchanged and set; it is also easy to achieve the thickness decrease of the workpiece rapidly and cleanly;

the constructional form of the working machine according to the invention permits setting with the tool in a vertical or horizontal direction or at a predetermined angle;

a qualitatively high surface working of the wood workpieces is possible irrespective of the previous wood cut in the longitudinal or transverse direction.

For this purpose the invention proceeds from a machine for surface and thickness working of wood workpieces, in particular of short and thin workpieces, consisting of one, two or more working spindles set vertically, horizontally or at a specific angle, a two-part sliding plate, a movable working table, two flank guide strips and an upper slide guide and separate working spindle drives.

The invention is distinguished by a partially hollow face cylinder milling head with fixed or interchangeable cutting edges, a guide insert secured to the one flank guide strip being fixed in the face cylinder milling head.

In this machine the guide strips are laterally adjustable and consist of two parts, one of which moves together with the working table whilst the other is fixed on the machine housing; likewise, two-part flank strips are mounted on the fixed part of the two-part slide plate which is fixed on the machine housing whilst the movable part of the slide plate moves in the vertical direction together with the working table; also present is an upper adjustable guide strip which is mounted on the machine housing.

Examples of embodiment of the invention will now be explained in detail with reference to the attached drawings, wherein.

Figure 1:
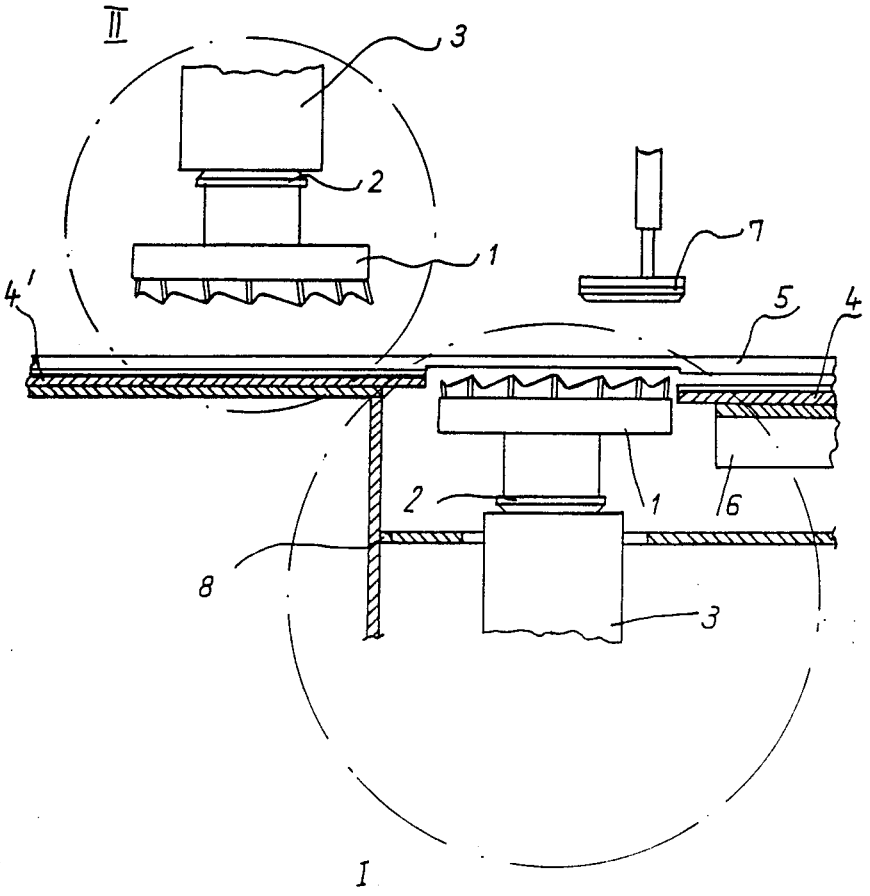
FIG. 1 is a side elevation (partially sectioned) of the machine for surface and thickness working for wood workpieces of any dimensions.
Figure 2:
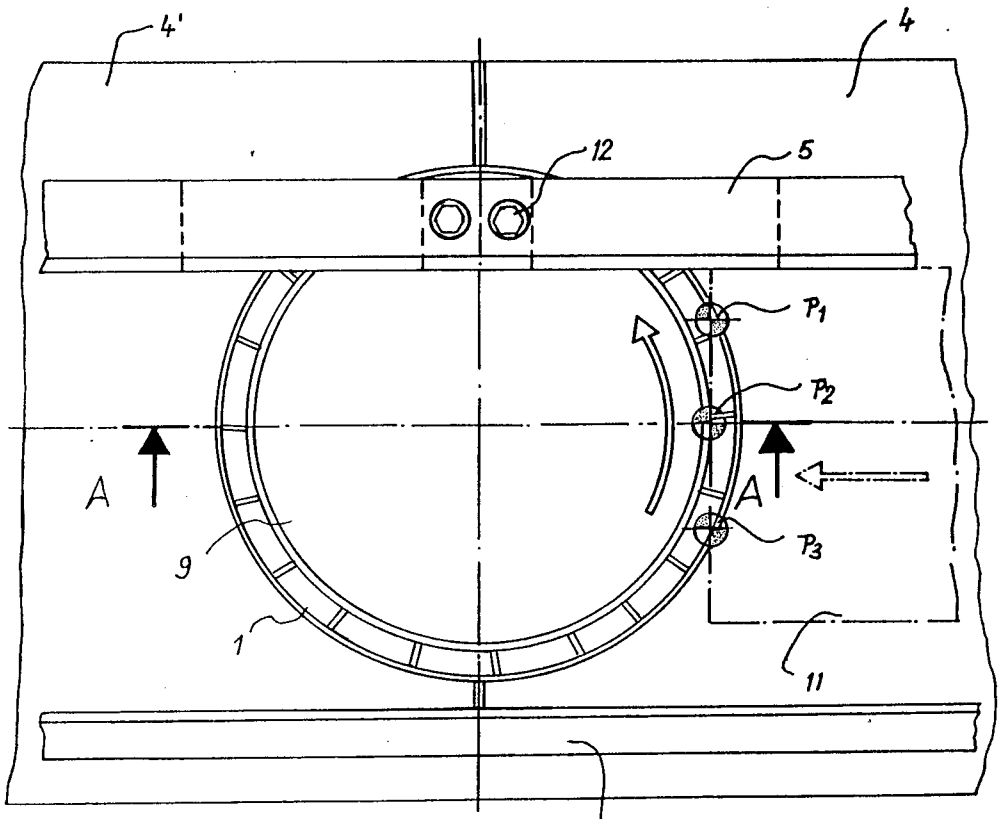
FIG. 2 is a plan view of the working spindle I of FIG. 1.

In accordance with FIG. 1 the surface and thickness finishing machine for wood workpieces of any dimensions, in particular short and thin workpieces, consists according to the invention of a working spindle I with milling head 1 for smooth working of the lower workpiece surface 11 newly shown in FIG. 2. Also provided is a working spindle II of the same construction which has a milling head 1 with compensation of the upper surface and thickness working of the workpiece 11 (FIG. 2); it is possible on the wood working machine according to the invention to use a plurality of working spindles which are disposed in a vertical or horizontal direction or at a predetermined angle on the respective working table 6 and to which the slide plate 4 is secured which moves vertically together with the working table 6; in this manner the thickness of the workpiece portion 11 (FIG. 2) can be set; the slide plate 4' is fixed on the machine housing 8 on which the upper guide strip 7 is secured; the guide strip or rail moves vertically; the workpiece height 11 (FIG. 2) is thus set.

According to FIG. 2 the working spindle I is provided with a hollow cylindrical milling head 1 into which the circular guide insert 9 is inserted; the circular guide insert is fixed via a screw connection 12 to a flank guide strip 5 which however in turn is mounted on the slide plate 4'. The workpiece slides on the slide plate 4 and is guided by the flank guide strip 5, the flank guide strip 10 and the upper guide strip 7 - FIG. 1. Furthermore, the position of the workpiece 11 with respect to the milling head 1 with fixed guide insert 9 can be seen, at the instant of the start of the surface working, as shown by points $P_1$, $P_2$, $P_3$, lying in the same plane with respect to the position of the milling head 1 fixed by the guide insert 9.

Figure 3:
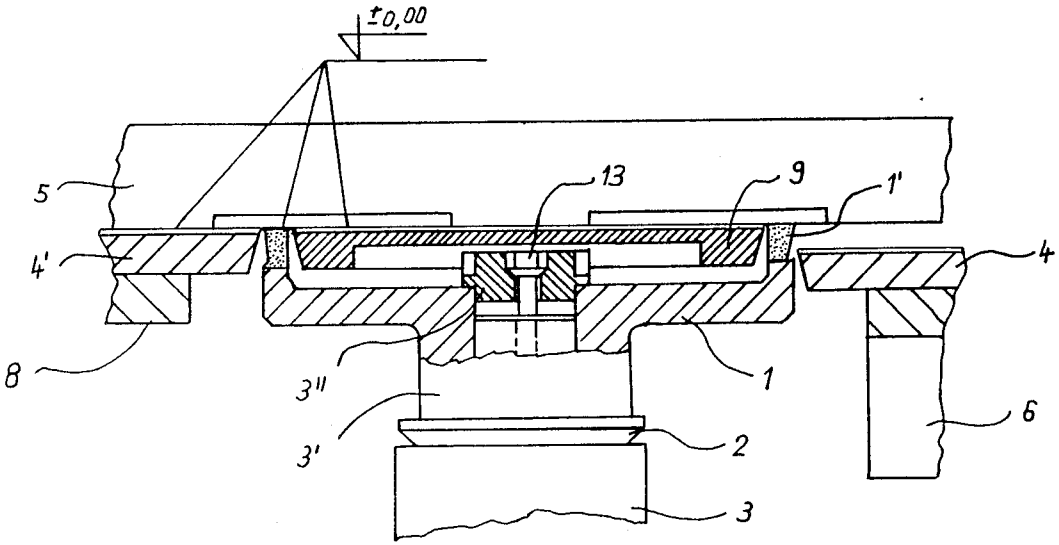
FIG. 3 is a partial axial section through the working spindle I.

In accordance with FIG. 3 the milling head 1 is provided with fixed or interchangeable cutting edges 1' on the working shaft 3' provided with an attached insert 3'' and a screw connection 13; the cutting edges 1' on the milling head are so set that the cutting edge apices 1' lie in the same plane as the upper slide plate surfaces and the upper surfaces of the fixed guide insert.

The slide plate 4 is fixed on the working table 6 and moves together with the latter vertically upwardly and downwardly in accordance with the desired removal thickness of the workpiece 11, as shown in FIG. 2.

The working shaft 3' is mounted on the housing of the working shaft 3 which is separated from the milling head 1 by a spacer ring 2. The slide plate 4' is mounted on the machine housing 8. Above and on said plate however, a flank strip 5 is fixed.

The workpiece 11 moving on the slide plate 4 is held by the flank strip 5, the flank strip 10 and the upper guide strip 7 which form together a movement channel, the workpiece 11 not being rigidly clamped. When the workpiece 11 has reached the cutting edges 1' on the milling head 1, the end face of the workpiece 11 is in engagement with the cutting edges 1' at the points $P_1$, $P_2$, $P_3$. The points lie in the same plane; the formation of moment forces is thus not possible but it is possible at the same time for the workpiece 11 to slide smoothly over the cutting edges 1' on the milling head 1 and over the fixed guide member 9 which in the case of relatively small (thin) material removals permits the working of a wood workpiece 11 without any additional pressure; the weight of the workpiece 11 itself on the slide plate 4 on the cutting edges 1' and on the fixed guide insert 9 (FIG. 2) thus suffices. The workpiece 11 moves over the cutting edges 1' on the milling head 1 and cuts in the same place as the upper surface of the slide plate 4', this being made possible by the fixed stationary guide insert 9 inserted in the milling head; this prevents tilting and sliding of a short workpiece 11 down into the inner portion of the hollow milling head 1 because the hollow inner portion in the milling head 1 is completely closed with the fixed guide insert; the workpiece is however so constructed that between the internal diameter of the hollow milling head 1 and the cutting edges 1' as well as the outer diameter of the fixed guide insert 9, an air inlet slot of at the most 1 mm width is disposed (FIG. 1). After completing the working — matching of the lower workpiece surface 11 with the working spindle I— the workpiece moves on the slide plate 4' beneath the working spindle II for equalization of the upper surface and thickness working of the workpiece 11 as is shown in FIG. 2. The engagement points $P_1$, $P_2$, $P_3$ between the milling head 1 with the cutting edges 1' and the fixed guide insert 9 and the face plane of the workpiece 11 are located in the same plane in such a manner that the working operation of the upper surface and the thickness working of the workpiece 11 is identical to the working operation for the working spindle I.

Figure 4:
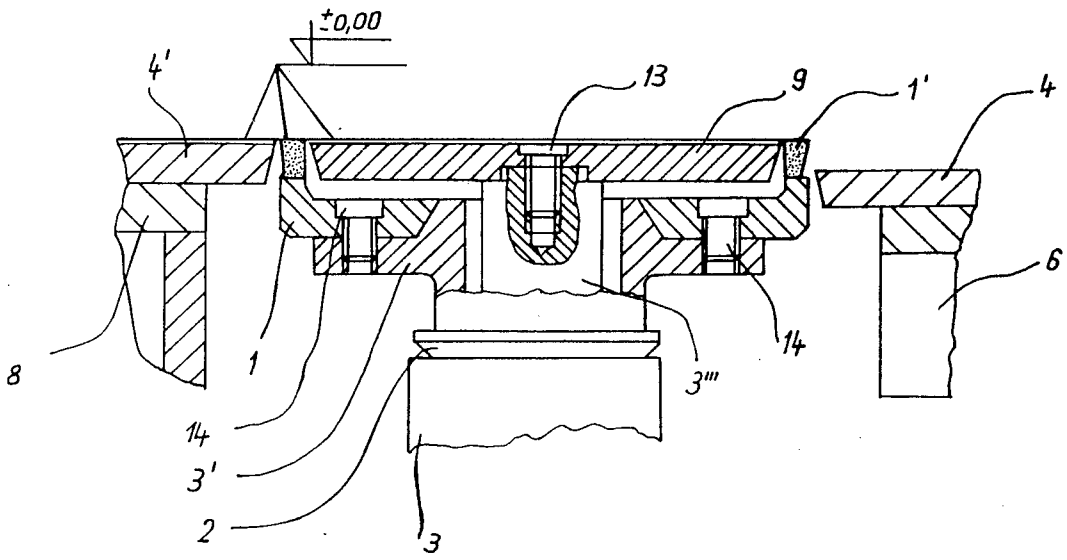
FIG. 4 is a partial axial section through the working spindle I; on the fixed shaft 3'''.

In accordance with FIG. 4 a constructional form of the mounting of the milling ring head 1 with the cutting edges 1' on the hollow working shaft 3' is shown; the upper portion merges into a flange form and the mounting is via a screw connection 14; a connection is provided in the housing of the working shaft 3 on which a spacer ring 2 is mounted.

A fixed shaft 3''' passes through the hollow working shaft 3' and the guide insert 9 is mounted thereon by means of the screw connection 13. The said insert is disposed in the inner portion of the milling head ring 1 with the cutting edges 1' in such a manner that the upper surface of the fixed guide insert 9, the cutting edge apex 1' on the milling head 1 and the upper surface of the slide plate 4' lie in the same plane.

With the constructional form of the machine for surface and thickness working of wood workpieces of different dimensions, one or more working spindles are set in the vertical and horizontal direction or at an angle to the slide plate 4 and 4'. Also, there is provided a hollow milling head 1 with fixed or exchangeable cutting edges 1' and a fixed guide insert 9 which is mounted in the head and fixed on the flank guide strip 5 (FIG. 2) but also secured at the top on the fixed shaft 3''' which is passed through the hollow working shaft 3', the upper surface of the fixed guide insert 9. The cutting edge apex 1' on the milling head 1 and the upper surface of the slide plate 4' always lying in the same plane as shown by the attached figures. A qualitatively high surface working of the wood workpieces 11 is achieved without rigid clamping irrespective of the dimensions, wood quality and direction of the previous wood cut.

What is claimed:

1. A machine for surface finishing short and thin workpieces which are too small to be clamped for finishing, comprising a working table supporting a movable slide plate and a stationary slide plate defining therebetween a sliding path for said workpiece, means for moving said working table in at least two planes, at least one spindle drivingly supporting a milling head, a pair of flank guide strips and a vertically adjustable upper slide guide for guiding the workpiece toward said milling head, said milling head having a concentric hollow face, said milling head being provided with peripheral interchangeable cutting edges, a guide insert insertable into said hollow face, and means for fixedly securing said guide insert to one of said flank guide strips, whereby said workpiece, as it moves past said milling head, is supported by said guide insert.

2. Machine according to claim 1, characterized in that said guide insert is mounted on a fixedly clamped shaft which is supported in a hollow working shaft.

3. Machine according to claim 2, characterized in that the milling head is made ring-shaped and is connected via a screw connection to the hollow working shaft, the end portion of which is provided with a flange.

4. Machine according to claim 1, characterized in that the upper guide surface of the guide insert lies in exactly the same plane as an upper slide surface of the stationary slide plate and also in exactly the same plane as a cutting apex on the milling head.

5. Machine according to claim 1, characterized in that in the slide plates, in each case, are provided with a semicircle cut-out within which the milling head together with the cutting edges is located.

6. Machine according to claim 1, characterized in that the movable slide plate is mounted on a vertically moving working table and moves with the working table.

7. Machine according to claim 1, characterized in that the flank guide strips are mounted on the stationary slide plate and are adjustable on the sliding path.

8. Machine according to claim 1, characterized in that an upper slide guide is secured at the top on a housing.

9. Machine according to claim 2, characterized in that the milling head is made ring-shaped and is connected via a screw connection to the hollow working shaft, the end portion of which is provided with a flange.

10. Machine according to claim 2, characterized in that the upper guide surface of the guide insert lies in exactly the same plane as an upper slide surface of the stationary slide plate and also in exactly the same plane as a cutting apex on the milling head.

11. Machine according to claim 3, characterized in that the upper guide surface of the guide insert lies in exactly the same plane as an upper slide surface of the stationary slide plate and also in exactly the same plane as a cutting apex on the milling head.

12. Machine according to claim 2, characterized in that the slide plates, in each case, are provided with a semicircle cut-out within which the milling head together with the cutting edges is located.

13. Machine according to claim 3, characterized in that the slide plates, in each case, are provided with a semicircle cut-out within which the milling head together with the cutting edges is located.

14. Machine according to claim 4, characterized in that the slide plates, in each case, are provided with a semicircle cut-out within which the milling head together with the cutting edges is located.

15. Machine according to claim 2, characterized in that the movable slide plate is mounted on a vertically moving working table and moves with the working table.

16. Machine according to claim 3, characterized in that the movable slide plate is mounted on a vertically moving working table and moves with the working table.

17. Machine according to claim 4, characterized in that movable slide plate is mounted on a vertically moving working table and moves with the working table.

18. Machine according to claim 5, characterized in that the movable slide plate is mounted on a vertically moving working table and moves with the working table.

19. Machine according to claim 2, characterized in that the flank guide strips are mounted on the stationary slide plate and are adjustable on the sliding path.

20. Machine according to claim 3, characterized in that the flank guide strips are mounted on the stationary slide plate and are adjustable on the sliding path.

* * * * *